US006453994B1

(12) United States Patent
Tart et al.

(10) Patent No.: US 6,453,994 B1
(45) Date of Patent: Sep. 24, 2002

(54) BUOYANT WATER PUMP SYSTEM

(76) Inventors: Willie F. Tart, 4104 Oak Hill Dr., Franklinton, NC (US) 27525; Mattie P. Tart, 4104 Oak Hill Dr., Franklinton, NC (US) 27525

( * ) Notice: Subject to any disclaimer, the term of this patent is extended or adjusted under 35 U.S.C. 154(b) by 22 days.

(21) Appl. No.: 09/759,079

(22) Filed: Jan. 12, 2001

(51) Int. Cl.[7] ..... E21B 43/00
(52) U.S. Cl. ..... 166/68; 166/105; 166/106
(58) Field of Search ..... 166/68, 68.5, 105, 166/106, 107

(56) References Cited

U.S. PATENT DOCUMENTS

| | | | | |
|---|---|---|---|---|
| 3,741,525 A | | 6/1973 | Smedley | |
| 3,871,618 A | | 3/1975 | Funk | |
| 3,991,978 A | | 11/1976 | Jones | |
| D254,509 S | | 3/1980 | Migchelbrink, Jr. | |
| 4,296,916 A | | 10/1981 | Jewett | |
| 5,097,902 A | * | 3/1992 | Clark | 166/106 |
| 5,253,845 A | | 10/1993 | Wilbert | |
| 5,358,038 A | * | 10/1994 | Edwards et al. | 166/105 |
| 6,257,338 B1 | * | 7/2001 | Kilgore | 166/187 |

* cited by examiner

*Primary Examiner*—David Bagnell
*Assistant Examiner*—Jennifer R. Dougherty

(57) ABSTRACT

A buoyant water pump system for reducing the difficulty involved in removing the pump from a well. The buoyant water pump system includes a conduit having a lumen and a lower end for inserting into the well. A pump assembly for pumping water from the well is mounted on the lower end of the conduit. The pump assembly includes a pump mounted on the conduit adjacent to the lower end thereof, and having an outlet that is fluidly coupled to the lumen of the conduit. A buoyant member is mounted on the conduit adjacent to the pump assembly to keep the pump assembly afloat.

10 Claims, 3 Drawing Sheets

BUOYANT WATER PUMP SYSTEM

BACKGROUND OF THE INVENTION

1. Field of the Invention

The present invention relates to pumps and more particularly pertains to a new buoyant water pump system for reducing the difficulty involved in removing the pump from a well.

2. Description of the Prior Art

The use of pumps is known in the prior art. More specifically, pumps heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,741,525; U.S. Pat. No. 4,296,916; U.S. Pat. No. 3,991,978; U.S. Pat. No. 5,253,845; U.S. Pat. No. 3,871,618; and U.S. Pat. No. Des. 254,509.

While these devices fulfill their respective, particular objectives and requirements, the aforementioned patents do not disclose a new buoyant water pump system. The inventive device includes a conduit having a lumen and a lower end for inserting into the well. A pump assembly for pumping water from the well is mounted on the lower end of the conduit. The pump assembly includes a pump mounted on the conduit adjacent to the lower end thereof, and having an outlet that is fluidly coupled to the lumen of the conduit. A buoyant member is mounted on the conduit adjacent to the pump assembly to keep the pump assembly near the surface of the water in the well.

In these respects, the buoyant water pump system according to the present invention substantially departs from the conventional concepts and designs of the prior art, and in so doing provides an apparatus primarily developed for the purpose of reducing the difficulty involved in removing the pump from a well.

SUMMARY OF THE INVENTION

In view of the foregoing disadvantages inherent in the known types of pumps now present in the prior art, the present invention provides a new buoyant water pump system construction wherein the same can be utilized for reducing the difficulty involved in removing the pump from a well.

The general purpose of the present invention, which will be described subsequently in greater detail, is to provide a new buoyant water pump system apparatus and method which has many of the advantages of the pumps mentioned heretofore and many novel features that result in a new buoyant water pump system which is not anticipated, rendered obvious, suggested, or even implied by any of the prior art pumps, either alone or in any combination thereof.

To attain this, the present invention generally comprises a conduit having a lumen and a lower end for inserting into the well. A pump assembly for pumping water from the well is mounted on the lower end of the conduit. The pump assembly includes a pump mounted on the conduit adjacent to the lower end thereof, and having an outlet that is fluidly coupled to the lumen of the conduit. A buoyant member is mounted on the conduit adjacent to the pump assembly to keep the pump assembly near the surface of the water in the well.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new buoyant water pump system apparatus and method which has many of the advantages of the pumps mentioned heretofore and many novel features that result in a new buoyant water pump system which is not anticipated, rendered obvious, suggested, or even implied by any of the prior art pumps, either alone or in any combination thereof.

It is another object of the present invention to provide a new buoyant water pump system which may be easily and efficiently manufactured and marketed.

It is a further object of the present invention to provide a new buoyant water pump system which is of a durable and reliable construction.

An even further object of the present invention is to provide a new buoyant water pump system which is susceptible of a low cost of manufacture with regard to both materials and labor, and which accordingly is then susceptible of low prices of sale to the consuming public, thereby making such buoyant water pump system economically available to the buying public.

Still yet another object of the present invention is to provide a new buoyant water pump system which provides in the apparatuses and methods of the prior art some of the advantages thereof, while simultaneously overcoming some of the disadvantages normally associated therewith.

Still another object of the present invention is to provide a new buoyant water pump system for reducing the difficulty involved in removing the pump from a well.

Yet another object of the present invention is to provide a new buoyant water pump system which includes a conduit having a lumen and a lower end for inserting into the well. A pump assembly for pumping water from the well is mounted on the lower end of the conduit. The pump assembly includes a pump mounted on the conduit adjacent to the lower end thereof, and having an outlet that is fluidly coupled to the lumen of the conduit. A buoyant member is mounted on the conduit adjacent to the pump assembly to keep the pump assembly near the surface of the water in the well.

Still yet another object of the present invention is to provide a new buoyant water pump system that reduces the number of individuals needed for removing the pump assembly from the well. Unlike the prior art systems that require a number of people or a lifting device to pull pumps up from the bottom of the well, the present invention uses a buoyant member to keep pump assembly near the surface of the water so that it may be more easily removed from the well.

Even still another object of the present invention is to provide a new buoyant water pump system that moves with the level of the surface of the water in the well. As the water level in the well changes the buoyant member moves the pump assembly accordingly. Additionally, the pump assembly is suspended adjacent to the surface of the water and away from the bottom of the well. Since the pump assembly is not on the bottom of the well, the potential for sediment entering the pump assembly is reduced.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
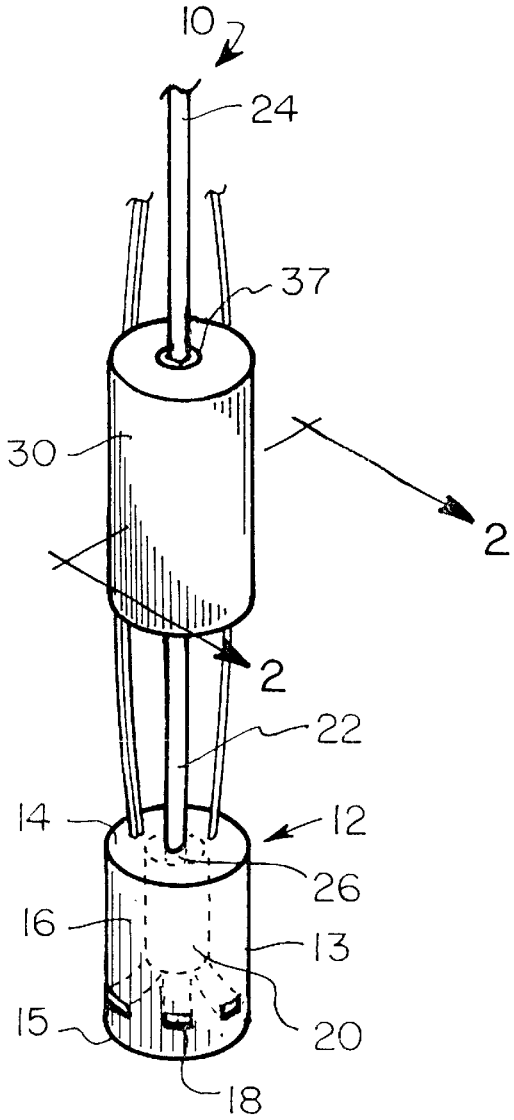
FIG. 1 is a schematic perspective view of a new buoyant water pump system according to the present invention showing a pump assembly and a buoyant member mounted on a conduit.
Figure 2A:
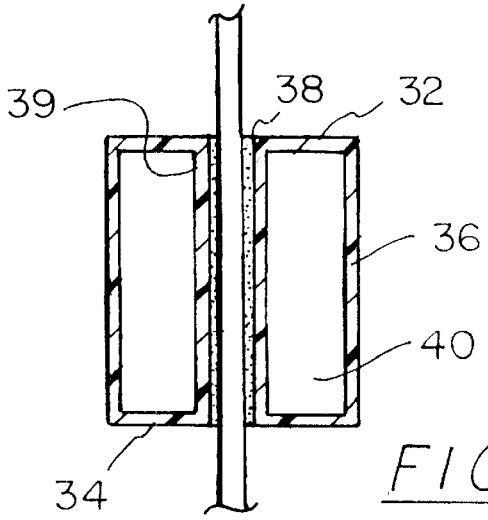
FIG. 2*a* is a schematic cross-sectional view of the present invention taken along line 2—2 of FIG. 1 showing an airtight inner cavity in the buoyant member.
Figure 2B:
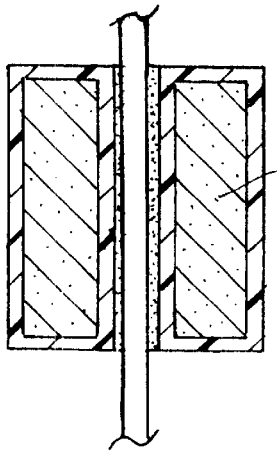
FIG. 2*b* is a schematic cross-sectional view of the present invention taken along line 2—2 of FIG. 1 showing a buoyant material being positioned in the inner cavity of the buoyant member.

With reference now to the drawings, and in particular to FIGS. 1 through 4 thereof, a new buoyant water pump system embodying the principles and concepts of the present invention and generally designated by the reference numeral 10 will be described.

As best illustrated in FIGS. 1 through 5, the buoyant water pump system 10 generally comprises a pump assembly 12 for pumping water from a well. The pump assembly 12 may include a housing 13 that has a top wall 14 and a bottom wall 15. A peripheral wall 16 is coupled to and extends between the top 14 and bottom 15 walls. As illustrated in FIG. 1, the peripheral wall 16 includes a plurality of holes 18 extending therethrough for permitting liquid to enter an interior of the housing 13. Each of the holes 18 may be uniformly spaced around the peripheral wall 16 and positioned generally adjacent to the bottom wall 15. The housing 13 may comprise a substantially rigid material such as, for example, a metal or a plastic.

The housing 13 when utilized in the system of the invention provides a means of protecting a pump 20 that is mounted in the interior of the housing 13. The pump 20 is in fluid communication with each of the holes 18 in the housing 13. The pump 20 is in fluid communication with a conduit 22 that has an upper end 24 and a lower end 26 extending in the well. The lower end 26 of the conduit 22 extends through the top wall 14 of the housing 13 and is fluidly coupled to an output of the pump 20 such that water may be pumped through a lumen in the conduit 22. The upper end 24 of the conduit preferably extends out of the well. The conduit 22 is elongated, and may comprise a substantially rigid material such as polyvinyl chloride.

Figure 3:
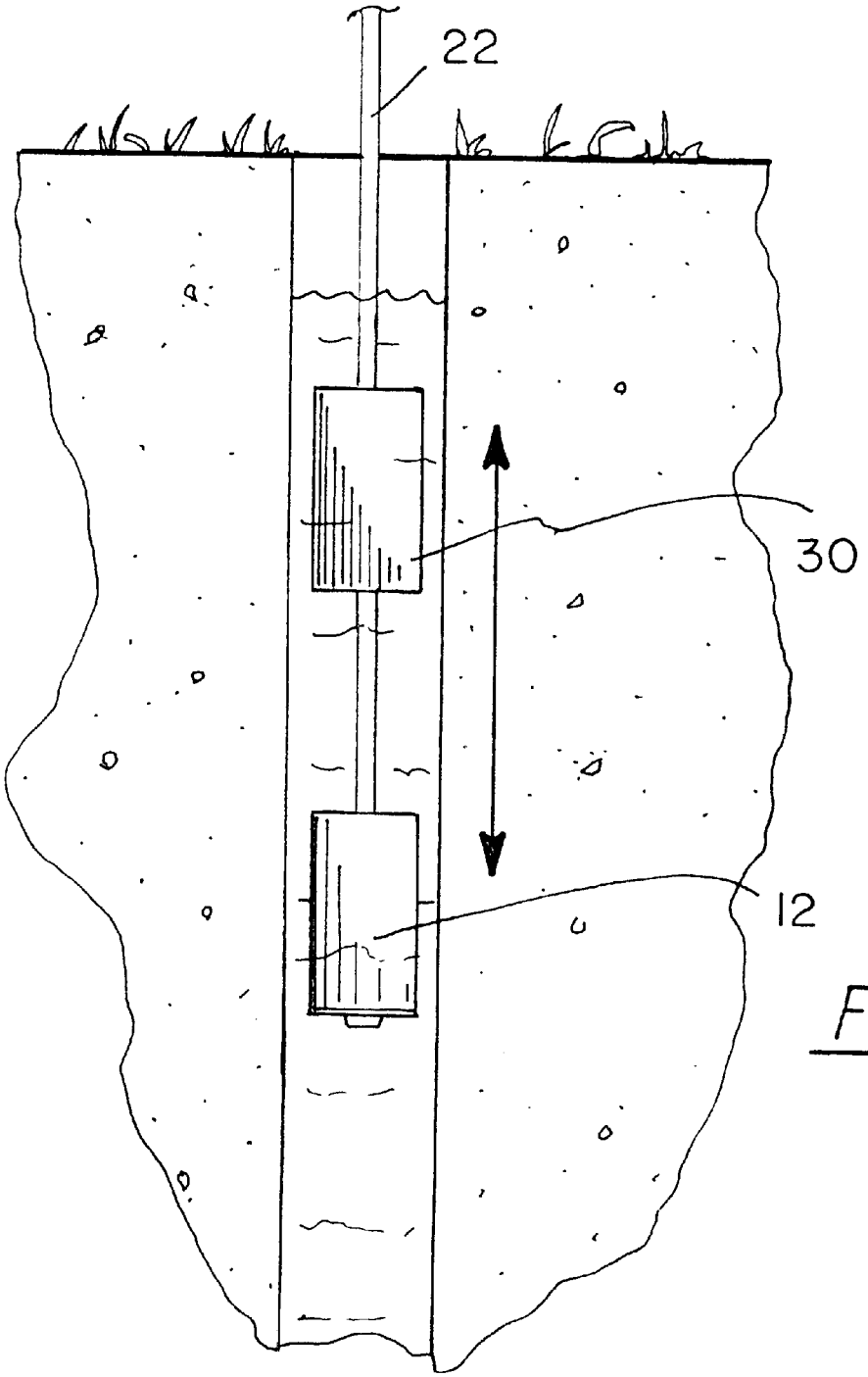
FIG. 3 is a schematic side view of the present invention showing the pump assembly and buoyant member positioned in a well.
Figure 4:
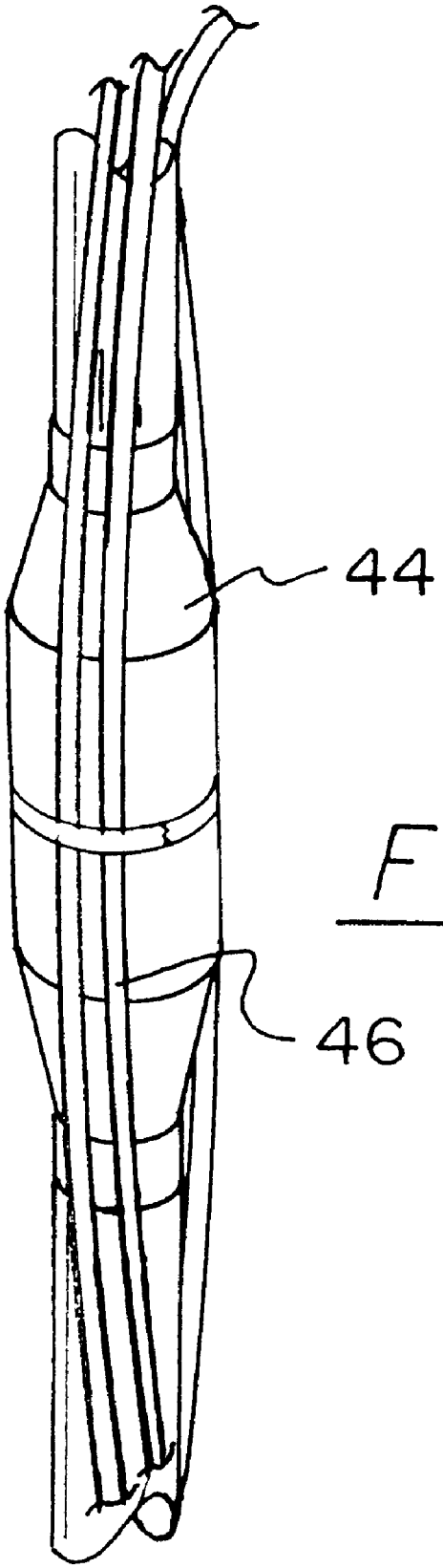
FIG. 4 is a schematic perspective view of the present invention showing an optional frusta-conical end formed on a top and a bottom wall of the buoyant member.

As illustrated by FIGS. 1 and 3, a buoyant member 30 is mounted on the conduit 22 with a portion of the conduit 22 extending through the buoyant member 30. The buoyant member 30 is positioned generally between the upper end 24 of the conduit 22 and the pump assembly 12. The buoyant member 30 includes an upper wall 32 and a lower wall 34. A peripheral wall 36 is coupled to and extends between the upper 32 and lower 34 walls of the buoyant member 30. The upper 32 and lower 34 walls of the buoyant member 30 each include an opening 37 extending therein such that the upper and lower walls 32 and 34 each have an interior peripheral edge 38 created by the opening 37. An intermediate wall 39 is coupled to and extends between the peripheral edge 38 of the upper 32 and lower 34 walls to form a tube receiving the conduit 22.

In one embodiment, an inner cavity 40 is formed between the intermediate wall 39 and the peripheral wall 36 of the buoyant member 30. The inner cavity 40 may be airtight so that it provides the buoyancy necessary to keep the pump assembly 12 afloat. Optionally, the inner cavity 40 may be filled with a buoyant material 42 such as, for example, a foam or a cork material if increased flotation is required due to using a relatively heavier pump assembly 12. The buoyant member 30 preferably has a generally cylindrical shape. However, the buoyant member may also have a variety of shapes such as, for example, a generally rectangular or spherical shape. The buoyant member 30 may comprise a generally rigid material such as, for example, a metal or a plastic.

The buoyant member 30 may also have a frusta-conical end 44 formed on the top 32 and bottom 34 walls of the buoyant member 30. The frusta-conical ends 44 provide a tighter seal between the conduit 22 and the inner cavity 40 of the buoyant member 30. The frusta-conical ends 44 also reduce the difficulty required to remove the buoyant water pump system 10 from the well by giving the top 32 and bottom 34 walls a more slippery shape to reduce the possibility of the housing catching on any protrusions in the well.

Optionally, a safety line 46 may be provided for supporting the pump assembly 12 in the well and is attached to the housing 13. A middle portion of the safety line 46 may be coupled to an outer surface 48 of the peripheral wall 36 of the buoyant member 30. A free end of the safety line 46 is extendable beyond the second end 24 of the conduit 22 where it can be secured to an anchoring object.

In use, the buoyant m ember 30 keeps the pump assembly 12 near the surface of the water for so that it may be more easily removed from the well. The safety line 46 attached to the to wall 14 of the housing 13 may be used to pull the pump assembly 12 from the well.

As to a further discussion of the manner of usage and operation of the present invention, the same should be apparent from the above description. Accordingly, no further discussion relating to the manner of usage and operation will be provided.

With respect to the above description t hen, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A buoyant water pump system for pumping water from a well, said system comprising:

a conduit having a lower end for inserting into the well;

a pump assembly for pumping water from the well, said pump assembly being mounted on the conduit adjacent to said lower end of said conduit, said pump assembly comprising;

a pump having an outlet being fluidly coupled to said conduit;

a buoyant member for biasing said pump assembly upward to facilitate removal of said pump assembly from the well, said buoyant member being mounted on said conduit adjacent to said pump assembly and being positioned generally between said pump assembly and a second end of said conduit opposite said lower end of said conduit; and wherein said buoyancy member biases said pump assembly upwardly when said buoyancy member is submerged such that an amount of force required to pull said pump assembly up out of the well is decreased.

2. The buoyant water pump system of claim 1 further comprising a housing having a top wall, a bottom wall, a peripheral wall being coupled to and extending between said top and bottom walls.

3. The buoyant water pump system of claim 2, wherein said peripheral wall of said housing ha s a plurality of holes extending therethrough for permitting liquid to enter an interior of said housing, said water pump being in fluid communication with each of said holes.

4. The buoyant water pump system of claim 2, further comprising a safety line for supporting said pump assembly in the well, said safety line being attached to said housing, a free end of said safety line being extendable beyond a second end of said conduit.

5. The buoyant water pump system of claim 1, wherein said buoyant member surrounds a portion of said conduit such that the portion of said conduit extends through said buoyant member.

6. The buoyant water pump system of claim 5, wherein said buoyant member has an upper wall, a lower wall, a peripheral wall being coupled to and extending between said upper and lower walls, said upper wall and said lower wall of said buoyant member each having an opening therein, an intermediate wall being coupled to and extending between said opening in said upper and lower walls to form a tube receiving said conduit.

7. The buoyant water pump system of claim 6, wherein an airtight inner cavity is formed between said intermediate wall and said peripheral wall of said buoyant member.

8.The buoyant water pump system of claim 6, wherein an inner cavity is formed between said intermediate wall and said peripheral wall of said buoyant member, a buoyant material being positioned in said inner cavity of said buoyant member for keeping said buoyant member afloat.

9. The buoyant water pump system of claim 6, further comprising a frusta-conical shoulder being formed on each of said upper and lower walls of said buoyant member.

10. A buoyant water pump system for pumping water from a well, said system comprising:

a pump assembly for pumping water from the well, said pump assembly comprising;

a housing having a top wall and a bottom wall, a peripheral wall being coupled to and extending between said top and bottom walls, said peripheral wall having a plurality of holes extending therethrough for permitting liquid to enter an interior of said housing, each of said holes being uniformly spaced around said peripheral wall and positioned generally adjacent to said bottom wall, said housing comprising a substantially rigid material;

a water pump being mounted in said interior of said housing, said water pump being in fluid communication with each of said holes in said housing;

a conduit extending through said top wall of said housing and being fluidly coupled to an output of said water pump such that water may be pumped through said conduit, said conduit being elongated and having a upper end and a lower end;

a buoyant member for biasing said pump assembly upward to facilitate removal of said pump assembly from the well, said buoyant member being mounted on said conduit with a portion of said conduit extending through said buoyant member, said buoyant member being positioned generally between said upper end of said conduit and said pump assembly, wherein said buoyancy member biases said pump assembly upwardly when said buoyancy member is submerged such that an amount of force required to pull said pump assembly up out of the well is decreased, said buoyant member having an upper wall and a lower wall, a peripheral wall being integrally coupled to and extending between said upper and lower walls, said upper wall of said buoyant member having an opening extending therein and extending through said lower wall such that said upper and lower walls each have a peripheral edge created by said opening, an intermediate wall being coupled to and extending between said peripheral edge of said upper and lower walls to form a tube receiving said conduit, wherein an airtight inner cavity between said intermediate wall and said peripheral wall of said buoyant member is defined, said buoyant member having a generally cylindrical shape, said buoyant member comprising a generally rigid material; and a safety line for supporting said pump assembly in the well, said safety line being attached to said housing, a middle portion of said safety line being coupled to an outer surface of said peripheral wall of said buoyant member, a free end of said safety line being extendable beyond said second end of said conduit.

* * * * *